US006551020B2

(12) United States Patent
Swanson et al.

(10) Patent No.: US 6,551,020 B2
(45) Date of Patent: Apr. 22, 2003

(54) VIBRATORY MECHANISM

(75) Inventors: Donald J. Swanson, Elk River, MN (US); Dean R. Potts, Maple Grove, MN (US); Gregory H. Dubay, Bologna (IT); Thomas J. Suelflow, Maplewood, MN (US)

(73) Assignee: Caterpillar Paving Products Inc., Minneapolis, MN (US)

( * ) Notice: Subject to any disclaimer, the term of this patent is extended or adjusted under 35 U.S.C. 154(b) by 0 days.

(21) Appl. No.: 09/911,779

(22) Filed: Jul. 24, 2001

(65) Prior Publication Data

US 2003/0021629 A1 Jan. 30, 2003

(51) Int. Cl.[7] ..... E01C 19/38

(52) U.S. Cl. ..... 404/117; 404/103; 404/130; 74/61; 74/87

(58) Field of Search ..... 404/103, 117, 404/122, 130, 133.05, 133.1, 133.2; 74/61, 87

(56) References Cited

U.S. PATENT DOCUMENTS

| | | | | |
|---|---|---|---|---|
| 2,349,778 A | | 5/1944 | Teplow | |
| 2,774,244 A | | 12/1956 | Bergstrom et al. | |
| 3,097,537 A | | 7/1963 | Peterson | |
| 3,909,147 A | | 9/1975 | Takata | |
| 4,152,943 A | * | 5/1979 | Wall | 74/87 |
| 4,211,121 A | | 7/1980 | Brown | |
| 4,412,757 A | | 11/1983 | Kummel et al. | |
| 4,454,780 A | * | 6/1984 | Goehler et al. | 74/87 |
| 4,481,835 A | | 11/1984 | Storm | |
| 4,527,680 A | * | 7/1985 | Sato | 192/215 |
| 4,568,218 A | | 2/1986 | Orzal | |
| 4,586,847 A | | 5/1986 | Stanton | |
| 5,134,893 A | | 8/1992 | Hukki et al. | |
| 5,666,852 A | | 9/1997 | Musschoot | |
| 6,241,420 B1 | * | 6/2001 | Perrin et al. | 404/117 X |

* cited by examiner

*Primary Examiner*—Heather Shackelford
*Assistant Examiner*—Sunil Singh
(74) *Attorney, Agent, or Firm*—Jeff A Greene

(57) ABSTRACT

A vibratory mechanism 26 is provided for a compacting work machine 10. The vibratory mechanism 26 includes a first/outer eccentric weight 50 and a second/inner eccentric weight 80. The second weight 80 has a cavity 88 with a movable mass 90 that when rotated in a first direction 124 opposes the first eccentric weight 50 and when rotated in a second direction 126 the movable mass 90 combines with the first eccentric 50. The second eccentric weight 80 is also manually indexable relative to the first eccentric 50 to a plurality of distinct positions giving a plurality of different amplitude vibratory impact forces when rotated in either of the first and second directions 124,126.

20 Claims, 7 Drawing Sheets

VIBRATORY MECHANISM

TECHNICAL FIELD

This invention relates to a vibratory mechanism for a compacting machine and more specifically to a vibratory mechanism that is selectable between a variety of distinct amplitude and frequency settings.

BACKGROUND

Compacting work machines are supported on one or more rotating drums that are used to roll over compactable materials, such as soil and aggregates, during the fabrication of roadways. The rotating drums include vibratory mechanisms mounted coaxially within the rolling drum to increase the compacting force during operation. It is desirable to have a mechanism that is adjustable so as to vary the amplitude and frequency of the compacting force so that the compacting machine is always at peak efficiency.

Many different vibratory mechanisms have been developed and used that create variable amplitude and frequency vibratory forces for compacting. However, many of these mechanisms are complicated and use a number of moving parts to index one eccentric weight relative to another to obtain a variable amplitude force. One such mechanism is disclosed in U.S. Pat. No. 4,481,835 issues on Nov. 13, 1985 and assigned to Dynapac Maskin AB. This system utilizes a first/outer cylindrical eccentric weight coaxially aligned with a second/inner cylindrical eccentric weight, both weights are rotatably supported on a shaft. The weights are drivingly connected to the shaft by a pin that is diametrically positioned through spiral grooves in the outer weight and a pair of spiral grooves in the inner weight and the shaft. The grooves in the outer weight spiral in the opposite direction of the outer weight. The rod of a single action hydraulic cylinder is positioned in an axial hollow opening of the shaft so as to push against the pin. When the rod is extended the outer weight and the inner weight index relative to one another via the spiral grooves. A spring is used to return the weights to a fixed position. This system is effective but complicated and requires a hydraulic cylinder to be rotatably mounted coaxial with a fluid drive motor that propels a rolling drum.

The present invention is directed to overcome one or more of the problems as set forth above.

SUMMARY OF THE INVENTION

In one aspect of the present invention a vibratory mechanism is provided. The vibratory mechanism includes a first eccentric weight having a first and a second stub shaft, which are rotatably supported by a pair of bearings. A second eccentric weight is coaxially rotatably supported on a shaft positioned within the first eccentric weight. A movable mass is contained within a hollow cavity in the second eccentric weight. An adjustment shaft is coaxially positioned within the first stub shaft and is operatively connected to the first and second eccentric weights and used for indexing the second eccentric weight relative to the first eccentric weight. Lastly, a motor is attached with the second stub shaft.

BRIEF DESCRIPTION OF THE DRAWINGS

FIG. 6 is cross sectional view taken along line 5—5 of FIG. 2 showing the location of the movable mass in a second location and with the second eccentric indexed to position two relative to the first eccentric weight;

DETAILED DESCRIPTION

Figure 1:
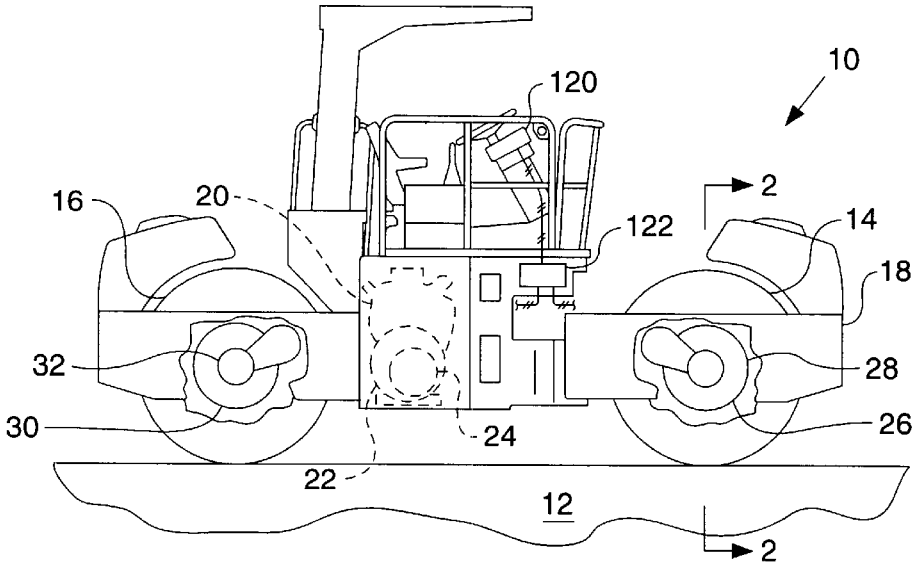
FIG. 1 is a side elevational view of a work machine embodying the present invention.

A work machine 10 for increasing the density of a compactable material 12 such as soil, gravel, or bituminous mixtures an example of which is shown in FIG. 1. The work machine 10 is for example, a double drum vibratory compactor, having a first compacting drum 14 and a second compacting drum 16 rotatably mounted on a main frame 18. The main frame 18 also supports an engine 20 that has a first and a second fluid pump 22,24 conventionally connected thereto.

The first compacting drum 14 includes a first vibratory mechanism 26 that is operatively connected to a first fluid motor 28. The second compacting drum 16 includes a second vibratory mechanism 30 that is operatively connected to a second fluid motor 32. The first and second fluid motors 28,32 are operatively connected, as by fluid conduits and control valves not shown, to the first fluid pump 22. It should be understood that the first and second compacting drums 14,16 might have more than one vibratory mechanism per drum without departing from the spirit of the present invention.

Figure 2:
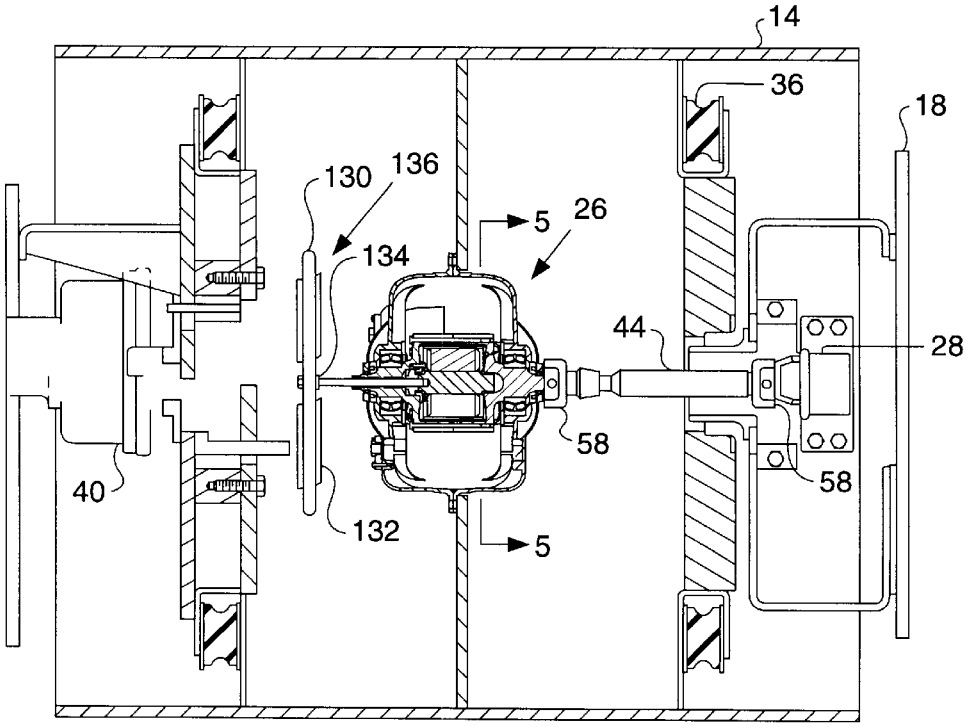
FIG. 2 shows an axial cross section view taken along line 2—2 through a rolling drum of the compacting machine of FIG. 1 embodying the present invention.

In as much as, the first compacting drum 14 and the second compacting drum 16 are structurally and operatively similar. The description, construction and elements comprising the first compacting drum 14, as shown in FIG. 2, applies equally to the second compacting drum 16. Rubber mounts 36 vibrationally isolate the compacting drum 14 from the main frame 18. The first compacting drum 14 includes a fluid motor 40 that is connected, as by fluid conduits and control valves not shown, to the second fluid pump 24. For example, the fluid motor 40 is connected to the main frame 18 and operatively connected to the first compacting drum 14 in a known manner. The second fluid pump 24 supplies a pressurized operation fluid, to fluid motor 40 for propelling the work machine 10. A shaft 44 connects the vibratory mechanism 26 to fluid motor 28. The first fluid pump 22 supplies a pressurized operation fluid, to fluid motor 28 for supplying rotational power to the first vibratory mechanism 26 thereby imparting a vibratory force on the compacting drum 14.

Figure 3:
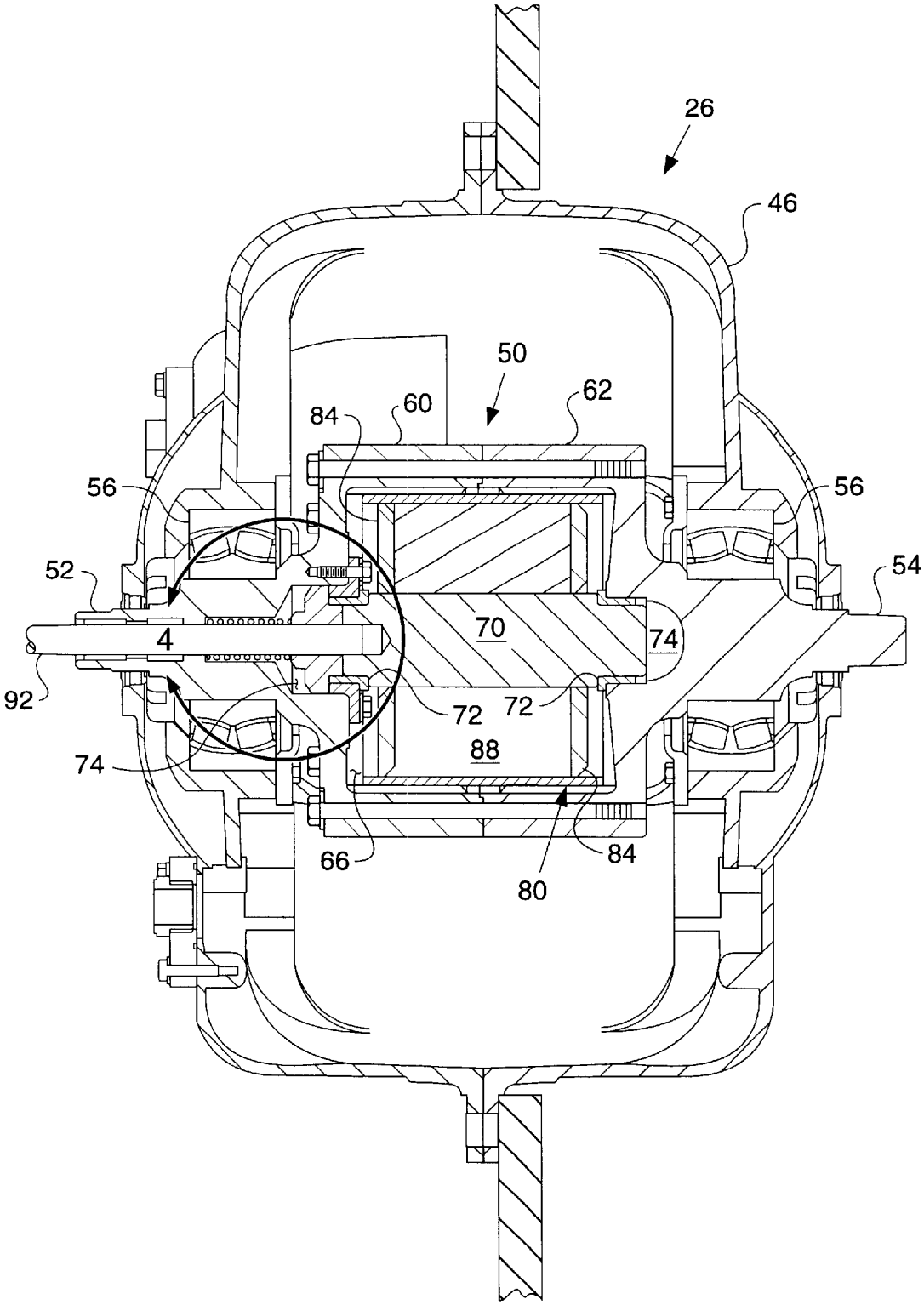
FIG. 3 is an enlarged view of the vibratory mechanism shown in FIG. 2.

Referring now to FIG. 3, the vibratory mechanism 26 is contained within a housing 46 that is attached to the first compacting drum 14. A first eccentric weight 50 includes a first and a second stub shaft 52, 54 that are rotatably supported by a pair of bearings 56. As best seen in FIG. 2 the second stub shaft 54 is connected to fluid motor 28 by the shaft 44 and a pair of universal connectors 58. The first eccentric weight 50 is a two-piece assembly that includes a first section 60 and a second section 62 that are assembled together, as by a plurality of fasteners. The first and second sections 60,62 create a cage like assembly that defines an inner cavity 66. Positioned within the cavity 66 is a shaft 70 that is journalled in a pair of bushings 72. The bushings 72 are located in a pocket 74 machined on the inner cavity 66 side of the first and second sections 60,62 concentric with the stub shafts 52,54. A second eccentric weight 80 is attached to the shaft 70. Thus, the shaft 70 coaxially rotatably supports the second eccentric weight 80.

The second eccentric weight 80, as best seen in FIGS. 3–7, includes an outer annular ring 82 that is held in concentric relationship to the shaft 70 by a pair of spaced apart side plates 84. Two radially extending plates 86 are attached to the shaft 70, the outer annular ring 82 and the spaced apart side plates 84 to form a hollow cavity 88. The two radially extending plates 86 form a wedge portion dividing the hollow cavity 88, however it should be understood that a single radially extending plate 86 would work as well. Additionally a casting, not shown, forming the hollow cavity 88 with a pair of machined ends to create the shaft 70 would work as an alternative to the above described assembly of components to form the second eccentric weight 80. A movable mass 90 is positioned within the hollow cavity 88 of the second eccentric weight 80. The movable mass 90 is shown, for exemplary purposes, as being a metallic shot however it should be understood that the moveable mass could be metal members, steel balls, liquid metal, sand, pendulum type weight, or a metal slug suspended in a liquid and still retain the functional attributes of the example shown.

Figure 4A:
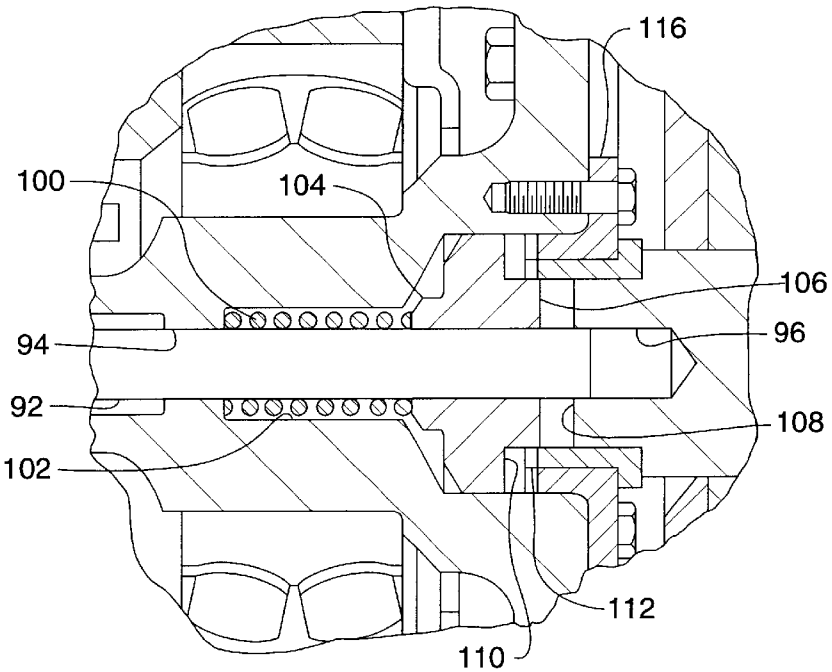
FIG. 4*a* is an enlarged view taken along lines 4—4 of FIG. 3 with the driver shown in an indexable orientation.
Figure 4:
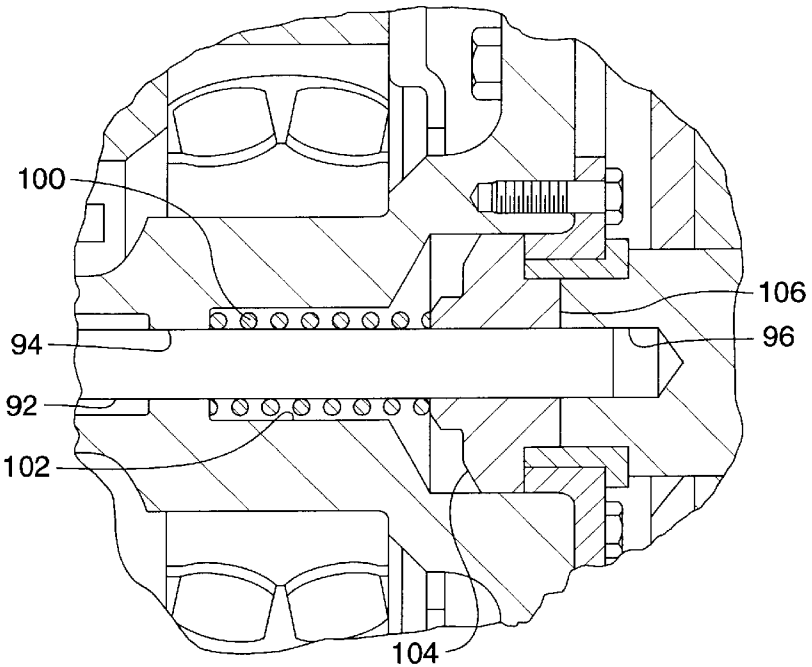
FIG. 4 is an enlarged view taken along lines 4—4 of FIG. 3.

Referring back to FIG. 3, an adjustment shaft 92 is slidably positioned within a bore 94 coaxially positioned in the first stub shaft 52. Adjustment shaft 92 extends through the first stub shaft 52 and has an end piloted into a pilot hole 96 in the shaft 70. Referring now to FIGS. 4 and 4*a*, a spring 100 is slidably disposed about the adjustment shaft 92 and abuts a counter bore 102 positioned adjacent the hollow cavity 88 in the bore 94. A driver 104 is fixedly attached to the adjustment shaft 92 having one end abutting the spring 100. Opposite the end abutting the spring 100 the driver 104 has a stepped end, the first step corresponding to a first radially extending face has a key 106 machined therein that engages a slot 108 in the end of shaft 70. The second step corresponding to a second radially extending face in the driver 104 has a key 110 that engages a pair of slots 112, one shown, in a bushing 116 that is fastened to the first section 60 of the first eccentric weight 50. While the driver 104 is disclosed as having keys 106,110 that engage slots 108,112 it should be understood that other known mechanical equivalents, such as a pin slid into mating holes, splines and the like, for locking the relative movement between the first and second eccentric weights 50,80 would work just as well.

Also shown in FIG. 1, is a control panel 120 connected to a controller 122 and to the first fluid pump 22 as by wire. The control panel 120, includes operator inputs such as switches, touch screens and the like, is used by the operator to select between high frequency operation and low frequency operation. When the operator selects high frequency from the control panel 120 the controller 122 sends a signal to the fluid pump 22. Fluid pump 22 is a variable or dual displacement pump capable of reversing flow direction at the two working ports that rotates the fluid motor 28 in a first direction 124 at a high rotational output speed when the operator selects high frequency. When the operator selects low frequency from the control panel 120, the controller 122 sends another signal to fluid pump 22 to rotate the fluid motor 28 in a second direction 126 at a lower rotational output speed.

Referring back to FIG. 2 a hand wheel 130 is attached to the adjustment shaft 92 opposite the driver 104. The hand wheel 130 is supported by a plurality of spokes 132 that are connected to a hub 134. The hub 134 is connected to the adjustment shaft 92 in a common manner, as by a retaining nut. The spokes 132 of the hand wheel 130 form a fan 136.

Industrial Applicability

Figure 5:
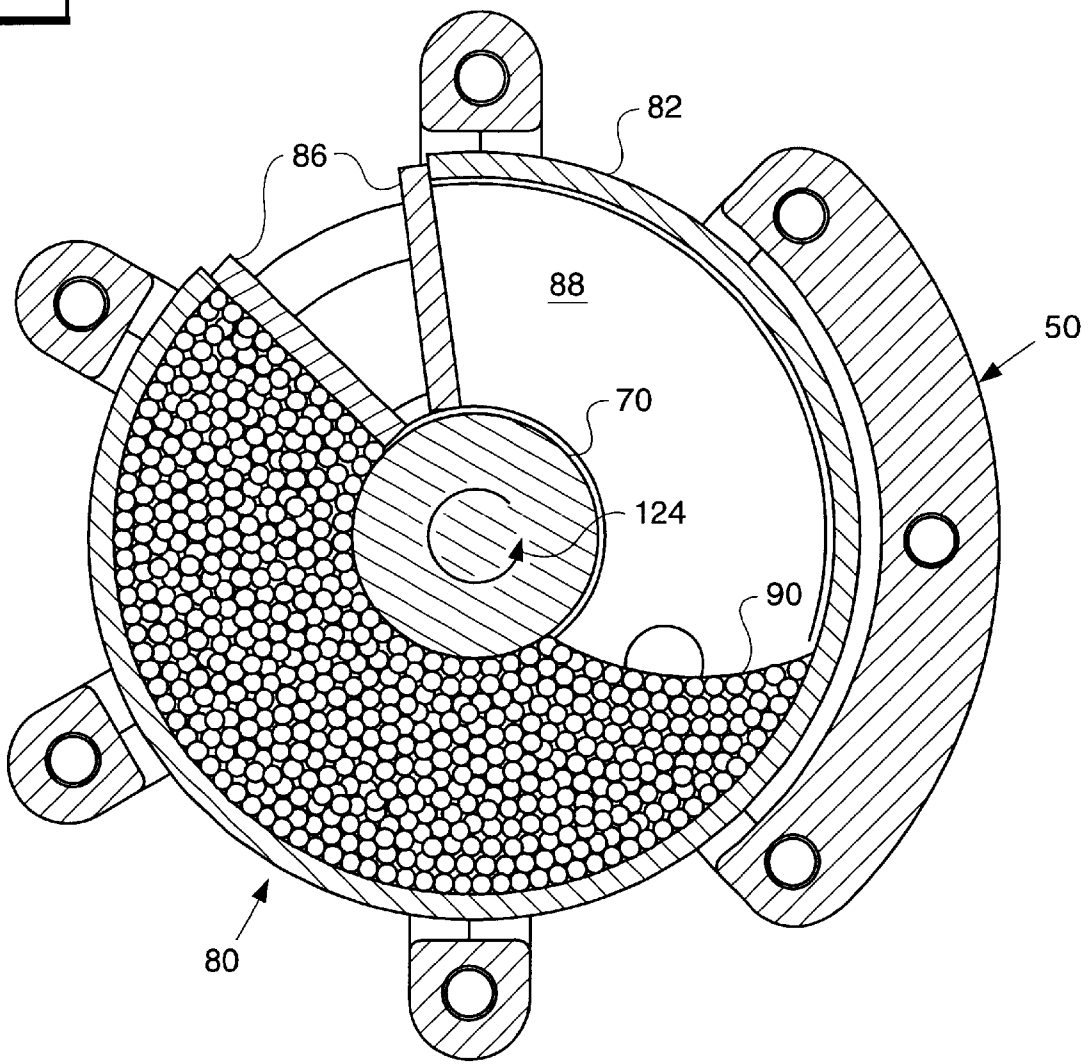
FIG. 5 is cross sectional view taken along line 5—5 of FIG. 2 showing the location of the movable mass in a first location and with the second eccentric indexed to position one relative to the first eccentric weight.
Figure 5:
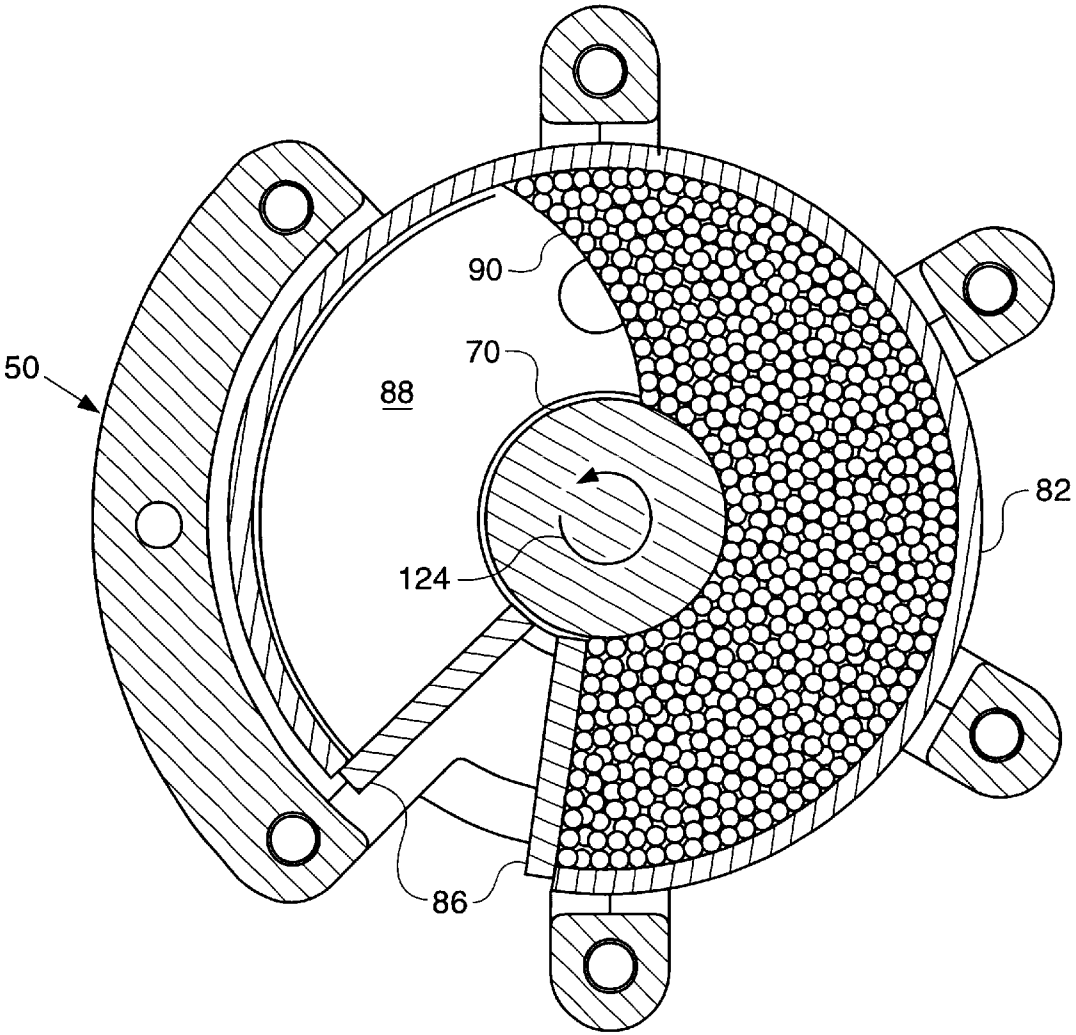
Figure 7:
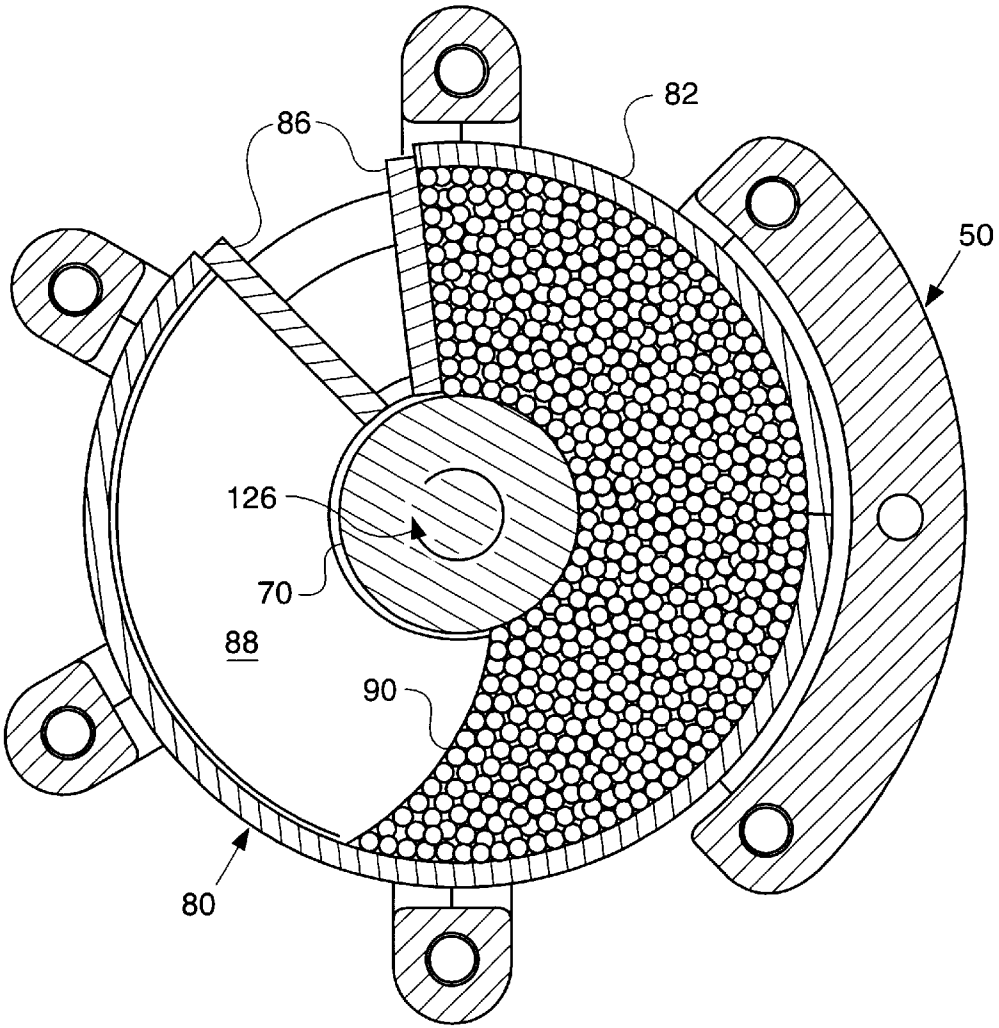
FIG. 7 is cross sectional view taken along line 5—5 of FIG. 2 showing the location of the movable mass in a first location and with the second eccentric indexed to position one relative to the first eccentric weight.
Figure 8:
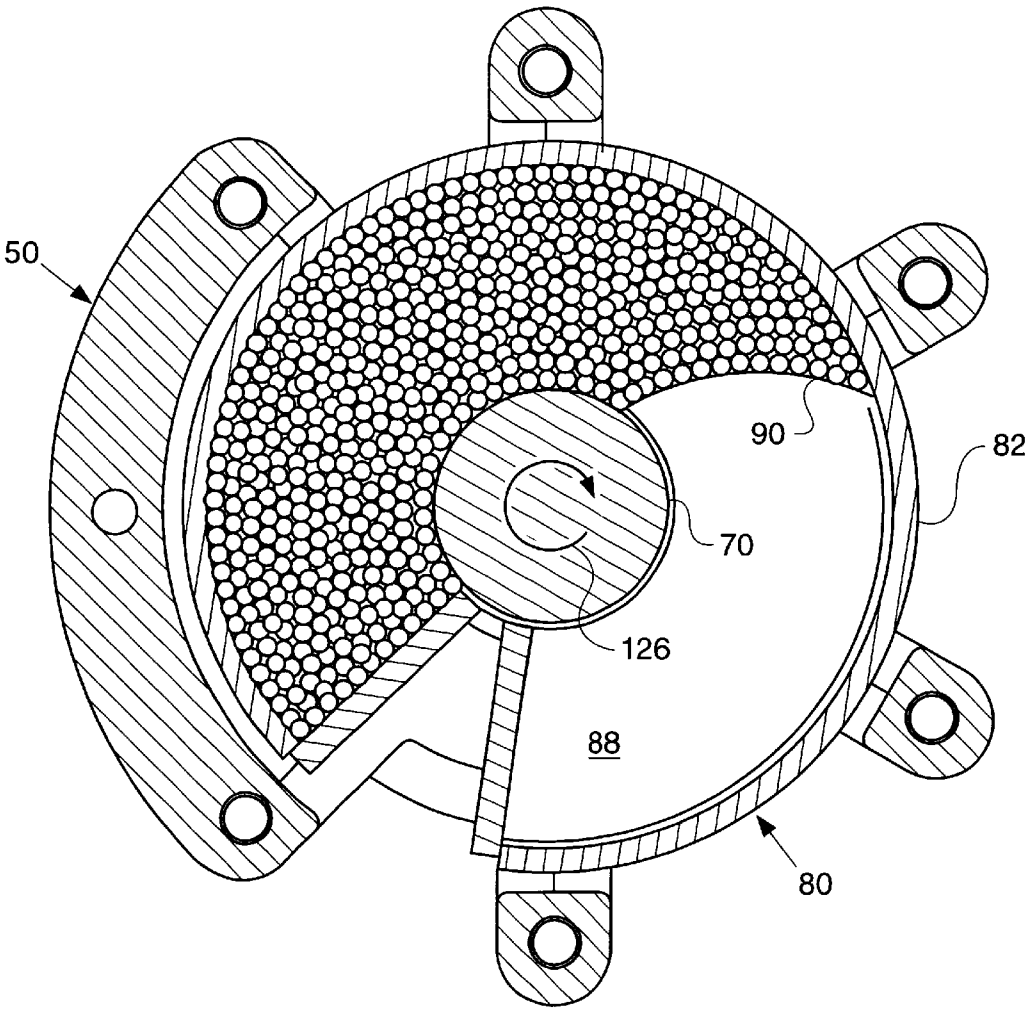
FIG. 8 is cross sectional view taken along line 5—5 of FIG. 2 showing the location of the movable mass in a second location and with the second eccentric indexed to position two relative to the first eccentric weight.

During a given compacting operation and from compacting job to job it is necessary to change the amplitude of the vibratory force being applied, by the compacting work machine 10, to the compactable material 12. The vibratory mechanism 26 disclosed herein provides a simple effective mechanism for offering this flexibility and operates as follows. When the operator starts any given compacting operation the first thing is to set the vibratory mechanism 26 to the desired amplitude. This is accomplished by changing the ova position of the second eccentric weight 80 relative to the first eccentric weight 50. Pulling back on the hand wheel 130 slides the indexing shaft 92 and the driver 104, so that the driver 104 pulls against spring 100. Pulling the driver 104 back disengages the key 110 from slots 112, while key 106 maintains engagement with slot 108. The hand wheel 130 is then rotated to the next position changing the position of the second eccentric weight 80 relative to the first eccentric weight 50, at which time the operator releases the hand wheel 130, the indexing shaft 92 and the driver 104. This causes the key 110 to slide into the next one of the pair of slots 112, locking the position of the second eccentric weight relative to the first eccentric weight 50. With the exemplary design described the second eccentric weight 80 is indexable in two distinct positions relative to the first eccentric weight 50 as is shown in FIGS. 5 and 7 (first position) and FIGS. 6 and 8 (second position) respectively. However, it should be understood that the same described mechanism could easily have a plurality of indexable positions.

The operator then selects the frequency of the vibratory mechanism 26 from the control panel 122. A signal is sent to the controller 122 based on either high frequency or low frequency selection. If high frequency is selected, the controller 122 sends a signal to the first fluid motor 22. The first fluid pump 22 then provides pressurized fluid to the first fluid motor 28 so that it rotates in the first direction 124 and at a high rotational speed. In the high frequency mode the movable mass 90 in the second eccentric weight 80 shifts to a position so as to opposes the first eccentric weight 50, as seen in FIGS. 4 and 5. When a low frequency setting is selected the controller 122 sends a signal to the first fluid pump 22 to supply pressurized fluid to the first fluid motor 28 so that it rotates in the second direction 126 and at a low rotational speed as seen in FIGS. 6 and 7. This arrangement provides a control arrangement that is simple to operate and makes it fail proof so that the operator cannot operate the vibratory mechanism 26 at high frequency and high amplitude.

Additionally, during operation the hand wheel 130 is configured with supporting spokes 132 that operates as a fan 136. During operation the hand wheel 130 assembly provides cooling air to the vibratory mechanism 26.

What is claimed is:

1. A vibratory mechanism comprising:

a housing supported within a compacting body;

a first eccentric weight positioned with said housing and having a first and a second stub shaft, the first and the second stub shaft being rotatably supported by a pair of bearings;

a second eccentric weight being coaxially rotatably supported on a shaft positioned within said first eccentric weight;

a movable mass being contained within a hollow cavity in said second eccentric weight;

an adjustment shaft extending outward from said housing and being coaxially positioned within said first stub shaft and being operatively connected to said first and second eccentric weights for indexing said second eccentric weight relative to said first eccentric weight; and a motor connected with said second stub shaft and rotatable in a first and a second direction.

2. The vibratory mechanism of claim 1, wherein the movable mass within the second eccentric weight shifts to a first position, when the motor is rotated in the first direction, opposing the first eccentric weight creating a low amplitude impact force, and the movable mass within the second eccentric weight shifts to a second position, when the motor is rotated in the second direction, combining with the first eccentric weight creating a high amplitude impact force.

3. The vibratory mechanism of claim 2, wherein said second eccentric weight is indexable in a plurality of distinct positions relative to said first eccentric weight.

4. The vibratory mechanism of claim 3, including a control panel that selectively controls the frequency of the multiple amplitude vibratory mechanism and creates a signal indicative of the desired frequency.

5. The vibratory mechanism of claim 4, including a controller that receives the signal from said control panel and responsively creates an output signal.

6. The vibratory mechanism of claim 5, wherein said output signal from said controller controls the rotation of said motor.

7. The vibratory mechanism claim 6, wherein the motor is rotated at a high output speed in said first direction and a low output speed in said second direction.

8. The vibratory mechanism of claim 1, including a driver connected to said adjustment shaft slidably positioned within said first stub shaft, said driver engages a plurality of slots in said first eccentric weight and a slot in the shaft supporting said second eccentric weight, said driver maintains the position of said first eccentric weight relative to said second eccentric weight.

9. The vibratory mechanism of claim 8, wherein said driver is held in place by a spring.

10. The vibratory mechanism of claim 1, including a hand wheel connected to said adjustment shaft.

11. The vibratory mechanism of claim 10, wherein the hand wheel is supported by a plurality of spokes connected to a hub that is attached to said adjustment shaft.

12. The vibratory mechanism of claim 11, wherein the spokes of said hand wheel define a fan that creates an air flow to cool said multiple amplitude vibratory mechanism during operative rotation thereof.

13. A work machine comprising:

a main frame;

an engine being supported by the main frame;

a pump operatively connected to the engine;

a fluid motor operatively connected to said pump, said fluid motor being rotatable in a first and a second direction;

at least one roller drum being rotatably connected to the main frame of the work machine;

a vibratory mechanism connected to said fluid motor and rotatably supported within a housing, said housing being concentrically positioned within said at least one roller drum and having;

a first eccentric weight positioned within said housing and having a first and a second stub shaft, the first and the second stub shaft being rotatably supported by a pair of bearings;

a second eccentric weight being coaxially rotatably supported on a shaft positioned within said first eccentric weight;

a movable mass being contained within a hollow cavity in said second eccentric weight; and an adjustment shaft extending outward from said housing and being coaxially positioned within said first stub shaft and being operatively connected to said first and second eccentric weights for indexing said second eccentric weight relative to said first eccentric weight.

14. The work machine of claim 13, wherein the movable mass within the second eccentric weight shifts to a first position, when the motor is rotated in the first direction, opposing the first eccentric weight creating a low amplitude impact force, and the movable mass within the second eccentric weight shifts to a second position, when the motor is rotated in the second direction, combining with the first eccentric weight creating a high amplitude impact force.

15. The work machine of claim 14, wherein said second eccentric weight is indexable in a plurality of distinct positions relative to said first eccentric weight.

16. The work machine of claim 13, including a control panel that selectively controls the frequency of the vibratory mechanism and creates a signal indicative of the desired frequency.

17. The work machine of claim 16, including a controller that receives the signal from said control panel and responsively creates an output signal.

18. The work machine of claim 17, wherein said output signal from said controller controls the rotation of said motor.

19. The work machine claim 18, wherein the motor is rotated at a high output speed in said first direction and a low output speed in said second direction.

20. The work machine of claim 13, including a driver connected to said adjustment shaft, said driver mates with a plurality of slots in said first eccentric weight and a slot in the shaft supporting said second eccentric weight, said driver maintains the position of said second eccentric weight relative to said first eccentric weight.

* * * * *